US008141685B2

(12) United States Patent
Utsunomiya

(10) Patent No.: US 8,141,685 B2
(45) Date of Patent: Mar. 27, 2012

(54) ELEVATOR APPARATUS HAVING VIBRATION DAMPING CONTROL

(75) Inventor: Kenji Utsunomiya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 496 days.

(21) Appl. No.: 12/441,649

(22) PCT Filed: Dec. 13, 2006

(86) PCT No.: PCT/JP2006/324815

§ 371 (c)(1),
(2), (4) Date: Mar. 17, 2009

(87) PCT Pub. No.: WO2008/072315

PCT Pub. Date: Jun. 19, 2008

(65) Prior Publication Data

US 2009/0266650 A1 Oct. 29, 2009

(51) Int. Cl.
*B66B 1/34* (2006.01)

(52) U.S. Cl. ..... 187/292; 187/391

(58) Field of Classification Search ..... 187/277, 187/292, 391–393, 409, 410; 318/116, 611, 318/623

See application file for complete search history.

(56) References Cited

U.S. PATENT DOCUMENTS

| | | | | |
|---|---|---|---|---|
| 5,597,988 | A * | 1/1997 | Skalski | 187/393 |
| 5,929,399 | A | 7/1999 | Jamieson et al. | |
| 6,338,396 | B1 * | 1/2002 | Morishita | 187/292 |
| 6,408,987 | B2 * | 6/2002 | Morishita | 187/292 |
| 6,474,449 | B1 | 11/2002 | Utsunomiya et al. | |
| 6,959,787 | B2 * | 11/2005 | Husmann | 187/292 |
| 7,164,251 | B2 * | 1/2007 | Morishita | 318/727 |
| 7,828,122 | B2 * | 11/2010 | Utsunomiya | 187/292 |
| 8,002,086 | B2 * | 8/2011 | Ito | 187/292 |

FOREIGN PATENT DOCUMENTS

| | | |
|---|---|---|
| JP | 7 2456 | 1/1995 |
| JP | 2659524 | 9/1997 |
| JP | 2000 63049 | 2/2000 |
| JP | 2001 122555 | 5/2001 |
| JP | 2001 183257 | 7/2001 |

* cited by examiner

*Primary Examiner* — Anthony Salata
(74) *Attorney, Agent, or Firm* — Oblon, Spivak, McClelland, Maier & Neustadt, L.L.P.

(57) ABSTRACT

In an elevator apparatus, an actuator for generating a vibration-damping force against the lateral vibration of a car is provided in parallel to elastic member for preventing the lateral vibration of the car. The actuator is controlled by a vibration-damping control unit. The vibration-damping control unit estimates a natural frequency of the lateral vibration of the car, determines a gain value on the basis of the estimated natural frequency and a rigidity value of the elastic member, and drives the actuator in accordance with an instruction signal obtained by multiplication of the determined gain value.

6 Claims, 8 Drawing Sheets

ELEVATOR APPARATUS HAVING VIBRATION DAMPING CONTROL

TECHNICAL FIELD

The present invention relates to an elevator apparatus including an actuator for reducing lateral vibration generated in a running car.

BACKGROUND ART

In recent years, the importance of vibration reduction technology for elevator car is increasing owing to speed increases of elevators accompanying increasing building heights. In response, in conventional vibration reduction devices for elevators, vibrations of a car frame are sensed by an acceleration sensor, and a force in a direction reverse to the direction of the vibrations is applied to the car by an actuator provided in parallel to a spring of a guide unit. In this vibration reduction device, as the proportional gain value, there is used a value which is stable for a variety of specifications of the car in terms of control, and from which a relatively good vibration-damping effect can be obtained (for example, refer to Patent Document 1).

Further, in a conventional control device of an electromagnetic actuator for an elevator active suspension, there is used an automatic gain control device which corrects nonlinearity with respect to an air gap of the electromagnetic attraction of the actuator and a current value (for example, refer to Patent Document 2).

Further, in a conventional running guide device for an elevator, a feedback characteristic correction means is used for correcting an acceleration feedback loop in accordance with car position and load weight (for example, refer to Patent Document 3).

[Patent Document 1] JP 2001-122555 A
[Patent Document 2] JP 2000-63049 A
[Patent Document 3] JP 7-2456 A

DISCLOSURE OF THE INVENTION

Problem to be Solved by the Invention

In the conventional vibration reduction device as described above in Patent Document 1, the value of the proportional gain is fixed. Accordingly, the best vibration-damping effect cannot always be obtained for various kinds of cars.

Further, an automatic gain adjustment function in a conventional control device of an electromagnetic actuator, which is described in Patent Document 2, is one to correct the nonlinearity of the electromagnetic attraction of the actuator, and is not one to optimally adjust the gain in accordance with characteristic differences among cars. Hence, the best vibration-damping effect cannot always be obtained for various kinds of cars.

Further, in Patent Document 3, it is not specifically described how initial feedback characteristics are to be decided, or how the feedback characteristics are to be corrected. Further, although car position (rope length) barely affects vibration characteristics in a lateral direction, it greatly affects vibration characteristics in a longitudinal direction. Therefore, the correction of the feedback characteristics for such lateral vibration control, which is performed in accordance with car position, not only has a small effect but also has a possibility of adversely affecting the control.

The present invention has been made in order to solve the problems as described above. It is an object of the present invention to provide an elevator apparatus capable of more appropriately reducing the lateral vibrations for various kinds of cars.

Means for Solving the Problems

An elevator apparatus of the present invention includes: a car; an elastic member that isolate lateral vibration of the car; a sensor that detects the lateral vibration of the car; an actuator that is provided in parallel to the elastic member, and generates vibration-damping force against the lateral vibration of the car; and a vibration-damping control unit that, on the basis of information from the sensor, determines the vibration-damping force generated by the actuator, and controls the actuator, in which the vibration-damping control unit estimates a natural frequency of the lateral vibration of the car, determines a gain value on the basis of the estimated natural frequency and a rigidity value of the elastic member, and drives the actuator in accordance with an instruction signal obtained by multiplication of the determined gain value.

BEST MODE FOR CARRYING OUT THE INVENTION

A description is made below of preferred embodiments of the present invention with reference to the drawings.

First Embodiment

Figure 1:
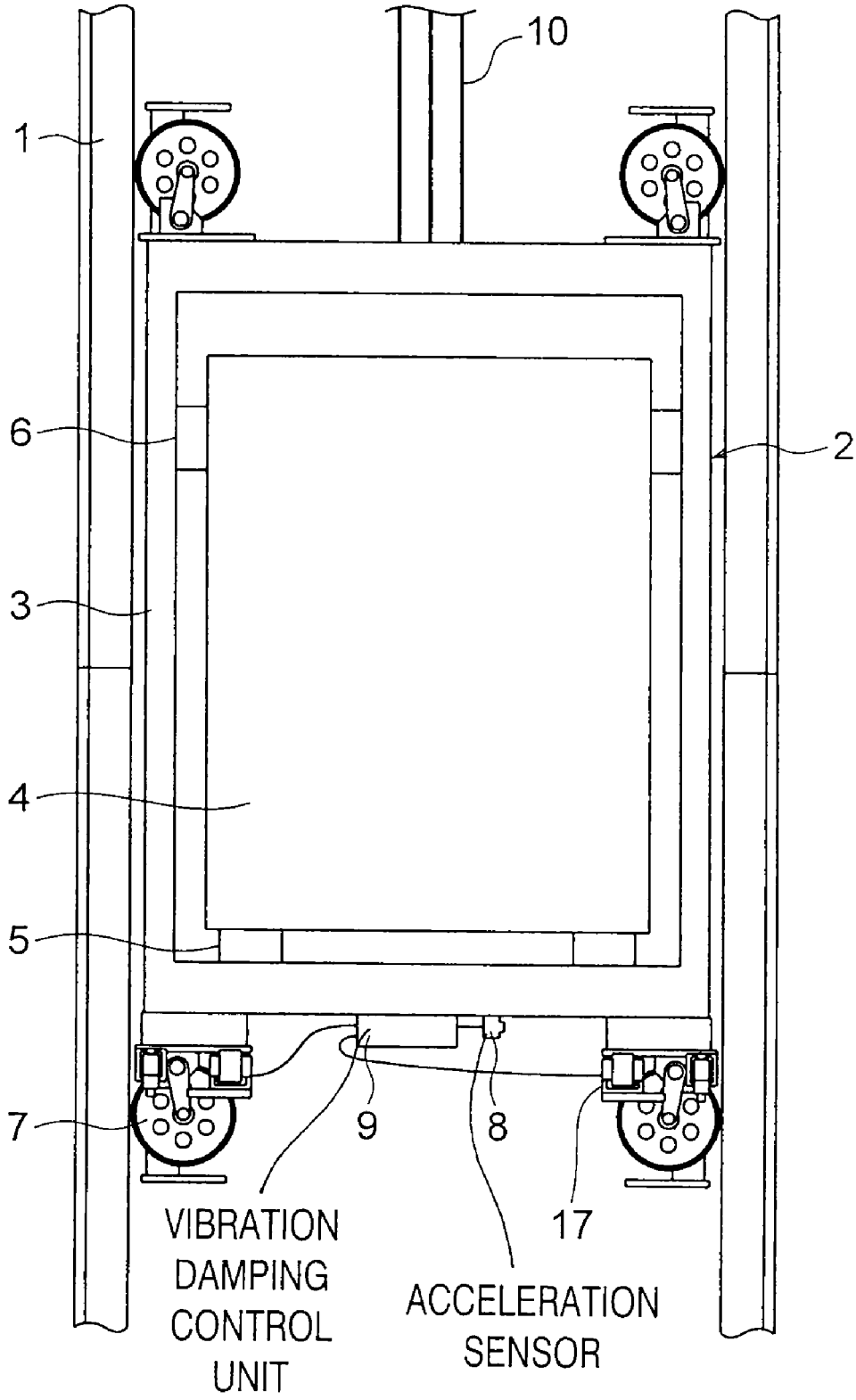
FIG. 1 A front view illustrating main portions of an elevator apparatus according to a first embodiment of the present invention.

FIG. 1 is a front view illustrating main portions of an elevator apparatus according to a first embodiment of the present invention. In FIG. 1, a pair of guide rails 1 is placed in an elevator pit. A car 2 is raised and lowered in the elevator pit while being guided by the guide rails 1. Further, the car 2 includes a car frame 3 and a car room 4 supported inside of the car frame 3. Between the car room 4 and a lower beam of the car frame 3, a plurality of vibration-isolating rubber pads 5 serving as vibration-isolating members (elastic members) are interposed. Further, between side surfaces of the car room 4 and left and right longitudinal columns of the car frame 3, a plurality of vibration-proof rubber pads 6 serving as vibration-isolating members (elastic members) which prevent inclination of the car room 4 are interposed.

On both crosswise end portions of upper and lower end portions of the car frame 3, roller guide devices 7 which are engaged with the guide rails 1 and guide the raising and lowering of the car 2 are individually mounted. Actuators 17 which generate a vibration-damping force for reducing lateral vibration generated in the car 2 are provided in the roller guide devices 7 mounted on the lower beam. Onto the lower beam, an acceleration sensor 8 that generates a signal for detecting a horizontal acceleration (lateral vibration) of the car frame 3 is attached.

Further, on the lower beam, a vibration-damping control unit 9 that controls the vibration-damping force of each of the actuators 17 is placed. On the basis of the signal from the acceleration sensor 8, the vibration-damping control unit 9 determines the vibration-damping force generated by each of the actuators 17. Specifically, an acceleration signal is transmitted from the acceleration sensor 8 to the vibration-damping control unit 9, and the vibration-damping force is calculated by the vibration-damping control unit 9 on the basis of the acceleration signal. Then, a result of the calculation is converted into a current signal by the vibration-damping control unit 9, and is transmitted to the actuators 17. The vibration-damping control unit 9 includes, for example, an arithmetic processing unit such as a microcomputer.

To an upper beam of the car frame 3, a plurality of main cables 10 which suspend the car 2 in the elevator pit is connected. The car 2 is raised and lowered in the elevator pit by drive force of a drive device (not shown) through the main cables 10.

Figure 2:
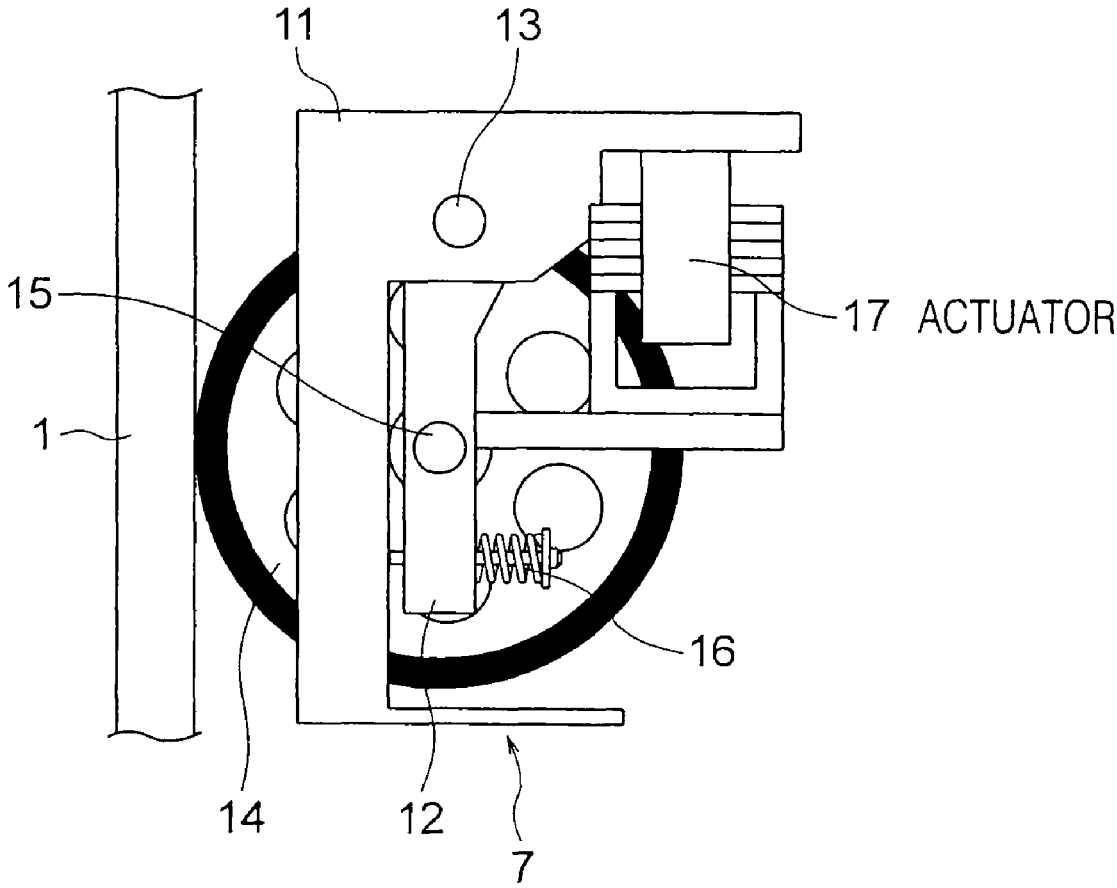
FIG. 2 A side view illustrating a guide device of FIG. 1.

FIG. 2 is a side view illustrating each roller guide device 7 of FIG. 1. A guide base 11 is fixed to the lower beam. Onto the guide base 11, a guide lever 12 is attached so as to be freely swingable about a swing shaft 13. Onto the guide lever 12, a guide roller 14 as a guide member rotated on the guide rail 1 following the raising and lowering of the car 2 is attached so as to be rotatable about a rotation shaft 15. The guide lever 12 is urged by a spring 16 serving as an elastic body in a direction where the guide roller 14 abuts on the guide rail 1.

The actuator 17 is provided between the guide base 11 and the guide lever 12 so as to become parallel to the spring 16, and controls urging force for the guide roller 14 to the guide rail 1. Further, for example, an electromagnetic actuator is used as the actuator 17. A control signal from the vibration-damping control unit 9 is inputted to the actuator 17.

Figure 3:
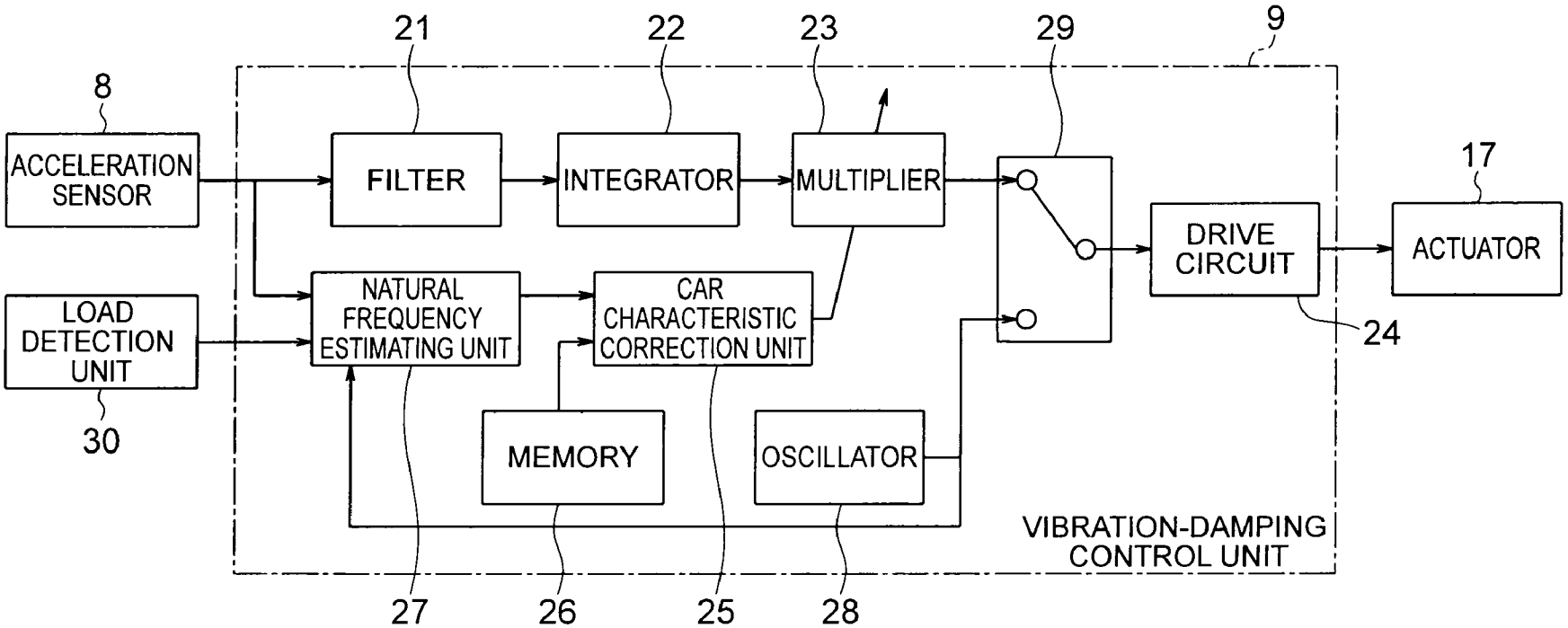
FIG. 3 A block diagram illustrating a vibration-damping control unit of FIG. 1.

FIG. 3 is a block diagram illustrating the vibration-damping control unit 9 of FIG. 1. The vibration-damping control unit 9 includes a filter (bandpass filter) 21, an integrator 22, a multiplier 23, a drive circuit 24, a car characteristic correction unit 25, a memory 26, a natural frequency estimating unit 27, an oscillator 28 and an output switching unit 29.

The filter 21 removes a frequency component, which is unnecessary for the control, from an acceleration detection signal inputted from the acceleration sensor 8. A passing frequency band (control band) of the filter 21 is a frequency (for example, 0.5 to 30 Hz) that affects human perception of a passenger, and an active control is executed for vibrations in this control band.

The integrator 22 converts the acceleration detection signal that has passed through the filter 21 into a speed signal. The multiplier 23 multiplies the speed signal from the integrator 22 by an appropriate gain. The drive circuit 24 drives the actuator 17 on the basis of an instruction signal from the multiplier 23. In such a way, in the actuator 17, a force for reducing the vibrations of the car 2 is generated.

The car characteristic correction unit 25 corrects a value of the gain for use in the multiplier 23 in accordance with characteristics of the car 2. In the memory 26, a spring constant of the spring 16 is prestored. The natural frequency estimating unit 27 estimates (identifies) a natural frequency of the lateral vibration of the car 2 on the basis of a signal from the oscillator 28 and on the signal from the acceleration sensor 8. The car characteristic correction unit 25 corrects a gain value on the basis of the spring constant of the spring 16, which is stored in the memory 26, and the natural frequency estimated by the natural frequency estimating unit 27.

At the time of normal control, the vibration-damping control unit 9 inputs the output signal of the multiplier 23 to the drive circuit 24 by the output switching unit 29. However, at the time of estimating the natural frequency after installation of the elevator is finished, the vibration-damping control unit 9 inputs the output signal of the oscillator 28 to the drive circuit 24 by the output switching unit 29. Further, during normal operation, the natural frequency estimating unit 27 changes an estimated value of the natural frequency on the basis of information from a load detection unit 30 that detects a load on the car 2. The vibration reduction device according to the first embodiment includes the actuator 17, the acceleration sensor 8, and the vibration-damping control unit 9.

Figure 4:
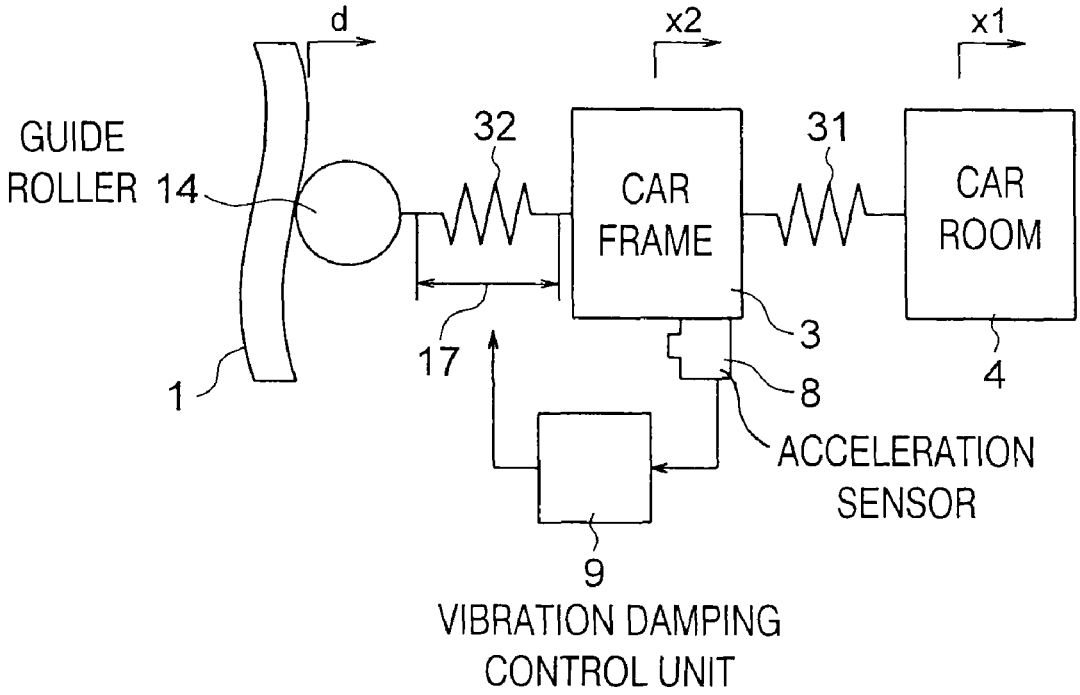
FIG. 4 An explanatory view illustrating a simple two-inertia model of lateral vibration in a car of FIG. 1.

Next, a description is made of a specific decision method of the gain value by the vibration reduction device according to the first embodiment. FIG. 4 is an explanatory view illustrating a simple two-inertia model of the lateral vibration in the car 2 of FIG. 1. In FIG. 4, the car room 4 is supported on the car frame 3 with a first equivalent spring 31 that exhibits total rigidity of the vibration-isolating rubber pads 5 and the vibration-proof rubber pads 6 being interposed therebetween. Between the car frame 3 and the guide roller 14, a second equivalent spring 32 that exhibits total rigidity of the springs 16 is disposed in parallel to the actuator 17.

Here, a mass of the car room 4 is defined as m1, a mass of the car frame 3 is defined as m2, and a spring constant (rigidity value) of the first equivalent spring 31 is defined as k1, and a spring constant (rigidity value) of the second equivalent spring 32 is defined as k2. Further, a displacement of the car room 4 is defined as x1, a displacement of the car frame 3 is defined as x2, and a displacement of the guide rail 1 is defined as d.

Figure 5:
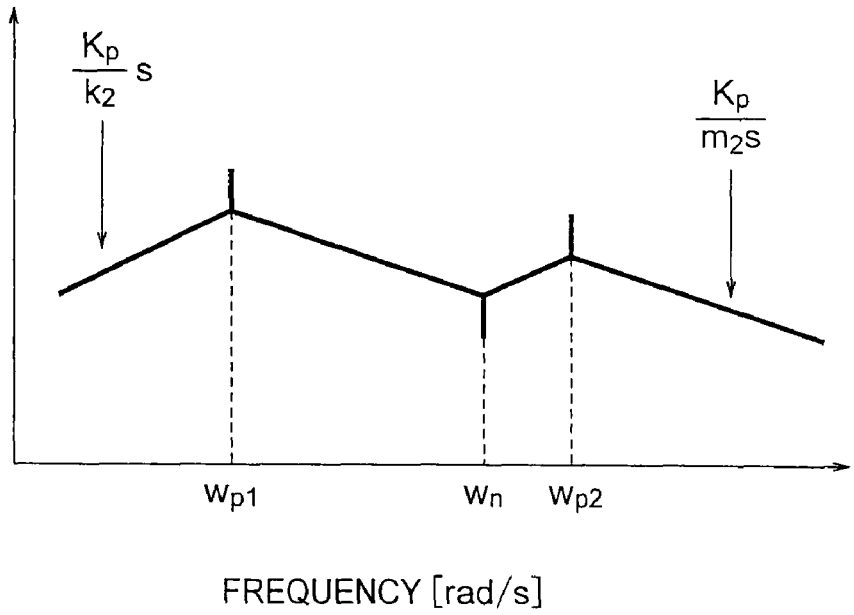
FIG. 5 A graph illustrating open-loop gain characteristics of a feedback loop composed of an actuator, an acceleration sensor, and the vibration-damping control unit of FIG. 1.

At this time, open-loop gain characteristics of a feedback loop composed of the actuator 17, the acceleration sensor 8 and the vibration-damping control unit 9 are as illustrated in FIG. 5. Note that characteristics of the filter 21 are ignored.

The open-loop gain characteristics have resonance peaks at frequencies wp1 and wp2, and become antiresonant at a frequency wn between these frequencies. Further, characteristics in a frequency range lower than wp1 are represented by Kp·s/k2, where the gain value of the multiplier 23 is Kp, and a Laplace operator is s.

Here, by simulation, it is verified that a resonant mode attenuation ratio at the primary natural frequency wp1 becomes an appropriate value by setting the 0 dB level of the open-loop gain characteristics between a resonant level at wp1 and antiresonant level at wn. As one of the designing methods of the gain value Kp in the multiplier 23 for this setting, there is considered a method of setting the 0 dB level of the open-loop gain characteristics on a root of the peak at the primary natural frequency wp1. Specifically, Kp·wp1/k2 is equal to 1, and a design value of the gain value Kp at this time is k2/wp1.

As described above, the gain value Kp of the multiplier 23 is decided on the basis of the spring constant k2 of the second equivalent spring 32 and the primary natural frequency wp1, whereby the resonant mode attenuation ratio is increased, and vibration reduction performance is improved. Hence, the car characteristic correction unit 25 of FIG. 3 decides the gain value on the basis of the spring constant of the spring 16 and the primary natural frequency, as inputs thereto.

Further, the spring 16 is frequently a coil spring, and accordingly, a relatively accurate value of the spring constant thereof is available in advance. Hence, it is possible to prestore the spring constant k2 in the memory 26.

On the contrary, with regard to the primary natural frequency wp1, it is difficult to grasp an accurate value thereof in advance because the mass of the car room 4 and the mass of the car frame 3 are frequently adjusted at the actual work site. In this connection, the primary natural frequency wp1 is automatically calculated by the natural frequency estimating unit 27 after installation of the elevator.

When the input to the drive circuit 24 is switched to the oscillator 28 after the installation of the elevator, a sweep wave containing, for example, frequencies of 1 to 5 Hz is inputted as a signal containing a plurality of frequencies around the primary natural frequency of the car 2 from the oscillator 28 to the drive circuit 24. However, the output signal of the oscillator 28 is not limited to the sweep wave.

When the actuator 17 is driven in accordance with the signal from the oscillator 28, vibrations occur in the car frame 3 and the car room 4. The vibrations are detected by the acceleration sensor 8, and the acceleration detection signal is inputted to the natural frequency estimating unit 27. The natural frequency estimating unit 27 estimates an initial value of the primary natural frequency from the signal from the oscillator 28 and from the signal from the acceleration sensor 8, and inputs a result of the estimation to the car characteristic correction unit 25. By the above-mentioned operations, the initial value (reference value) of the gain value Kp of the multiplier 23 is decided.

During normal operation, the primary natural frequency varies due to loading and unloading of passengers in the car room 4. Therefore, the natural frequency estimating unit 27 corrects the primary natural frequency on the basis of the information from the load detection unit 30. Then, the car characteristic correction unit 25 corrects the gain value Kp of the multiplier 23 on the basis of the information from the natural frequency estimating unit 27.

Note that, though the configuration of the car 2 in the left and right direction is only illustrated here, the car 2 has a similar configuration also in a fore and aft direction (normal direction with respect to the page surface of FIG. 1).

In the elevator apparatus as described above, the natural frequency of the lateral vibration of the car 2 is estimated, the gain value is determined on the basis of the estimated natural frequency and the spring constant of the spring 16, and the actuator 17 is driven in accordance with the instruction signal obtained by the multiplication of the determined gain value. Accordingly, feedback control characteristics suitable for each specification can be obtained for the various kinds of car 2, and the lateral vibration can be reduced more appropriately, whereby a comfortable ride feeling can always be offered.

Further, the spring constant of the spring 16 is prestored in the memory 26, whereby the gain value can be obtained easily.

Further, the vibration-damping control unit 9 can generate lateral vibration for the car 2 by the actuator 17, and can estimate the natural frequency of the car 2 on the basis of a vibration excitation signal at that time and the signal from the acceleration sensor 8. Accordingly, the vibration-damping control unit 9 can simply and accurately grasp the initial value of the natural frequency of the car 2, which is difficult to grasp before installation.

Still further, during the normal operation, the vibration-damping control unit 9 corrects the reference value of the natural frequency of the car 2 on the basis of the information from the load detection unit 30. Accordingly, the vibration-damping control unit 9 can obtain a more appropriate gain value in real time in accordance with the actual load. In such a way, it becomes possible to perform a finer control, and a better ride feeling can be realized.

Second Embodiment

Figure 6:
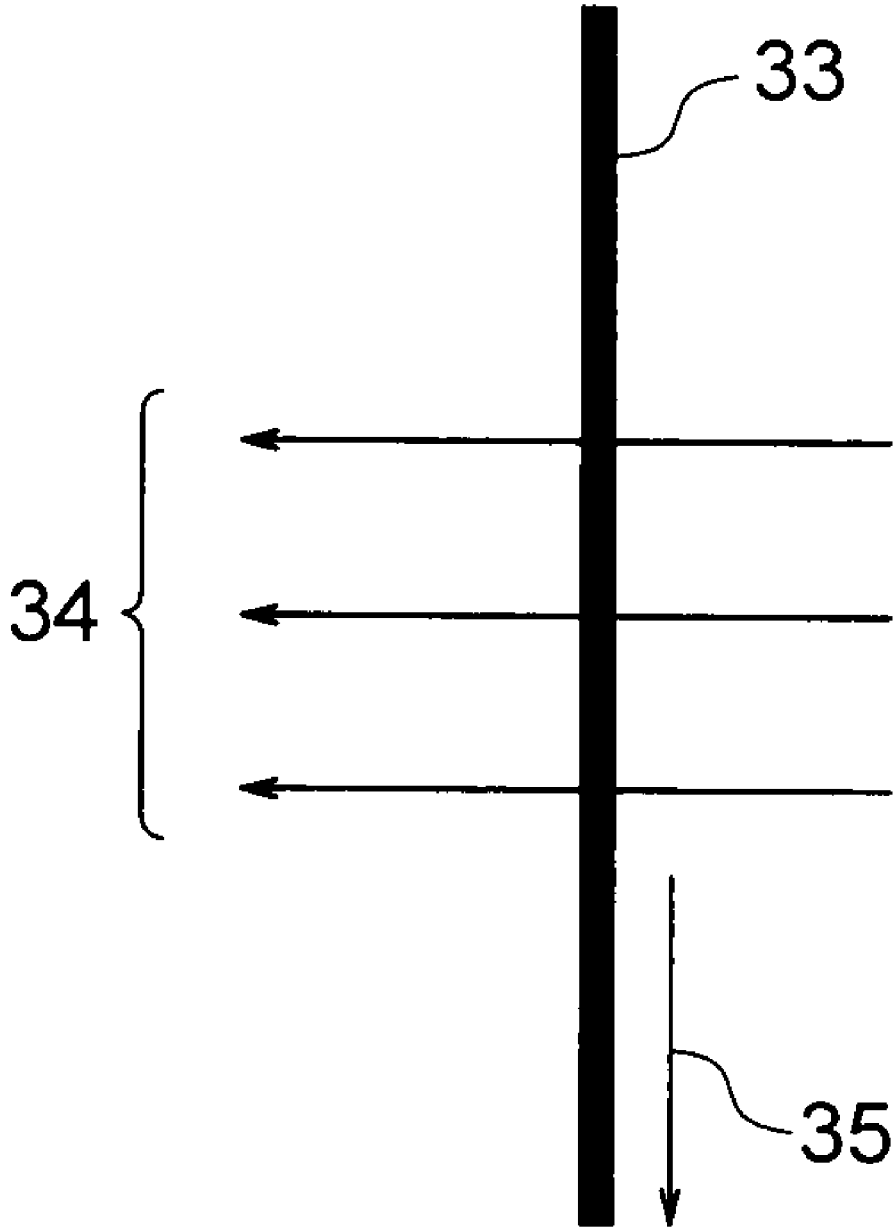
FIG. 6 An explanatory view illustrating a principle of a voice coil type actuator.

Next, description is made of a second embodiment of the present invention. In the second embodiment, a voice coil type actuator is used as the actuator 17. FIG. 6 is an explanatory view illustrating a principle of the voice coil type actuator. In FIG. 6, a coil 33 is located in a magnetic circuit indicated by arrows 34. When current flows through the coil 33 as indicated by an arrow 35, Lorentz force proportional to intensity of a magnetic field and a value of the current is generated from the back of the page surface of FIG. 6 to the front thereof in accordance with Fleming's left-hand rule. An actuator utilizing this Lorentz force is the voice coil type actuator.

Meanwhile, when the coil 33 moves in the magnetic field, a counter electromotive force is generated in the coil 33. For example, when the coil 33 moves from the front of the page surface of FIG. 6 to the back thereof, such counter electromotive force that flows the current in a direction reverse to that indicated by the arrow 35 is generated in proportion to the speed of the coil 33 and the intensity of the magnetic field.

Figure 7:
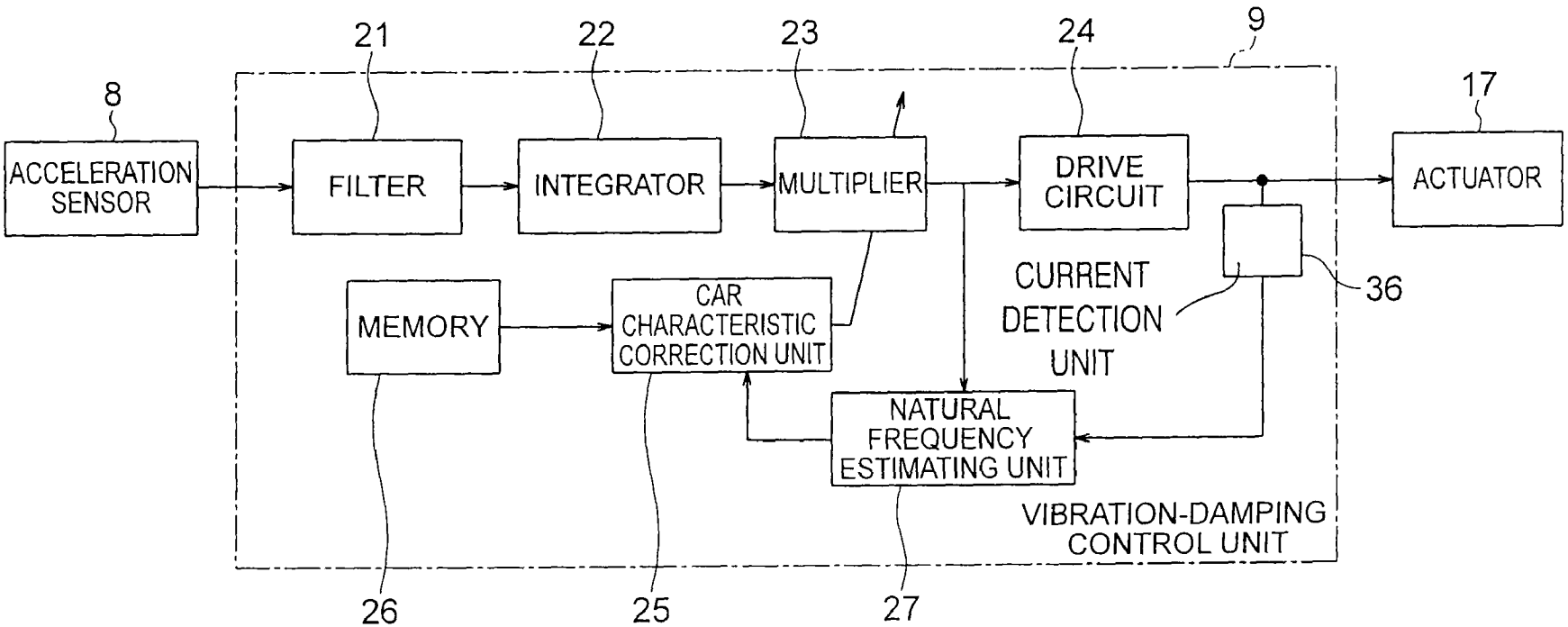
FIG. 7 A block diagram illustrating a vibration-damping control unit of a vibration reduction device according to a second embodiment of the present invention.

FIG. 7 is a block diagram illustrating a vibration-damping control unit 9 of a vibration reduction device according to the second embodiment of the present invention. The vibration-damping control unit 9 of the second embodiment includes the filter 21, the integrator 22, the multiplier 23, the drive circuit 24, the car characteristic correction unit 25, the memory 26, the natural frequency estimating unit 27 and a current detection unit 36.

The current detection unit 36 detects the current of the coil 33 of the actuator 17. The natural frequency estimating unit 27 detects the counter electromotive force from a voltage instruction value as an output of the multiplier 23 and from a value of the current detected by the current detection unit 36, and estimates the first natural frequency from the counter electromotive force.

Here, in a primary inherent vibration mode of the car 2, in general, the spring 16 is located on a loop (spot where relative vibrations are the most likely to occur) of the mode. Accordingly, it is possible to estimate the primary natural frequency from the counter electromotive force proportional to the speed of the coil 33. Other configurations are similar to those of the first embodiment.

In the elevator apparatus as described above, the current flowing through the actuator 17 is detected, and the natural frequency of the car 2 is estimated from the counter electromotive force determined on the basis of a voltage value directed to the actuator 17 and the current value of the actuator 17. Accordingly, the primary natural frequency can be measured in real time during normal operation. In such a way, the feedback control characteristics can always be optimally maintained, and good ride feeling can be offered.

Third Embodiment

Figure 8:
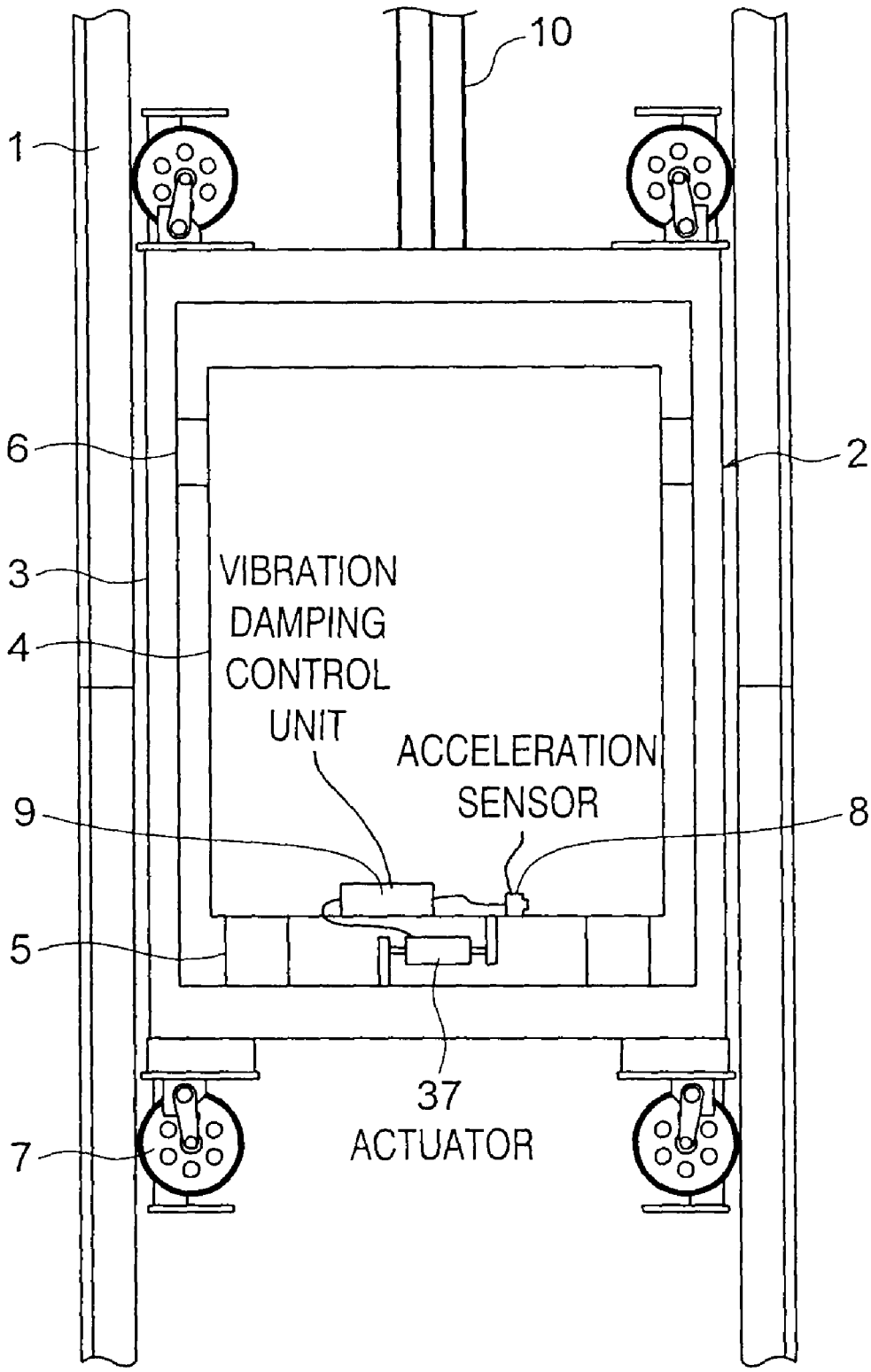
FIG. 8 A front view illustrating main portions of an elevator apparatus according to a third embodiment of the present invention.

Next, FIG. 8 is a front view illustrating main portions of an elevator apparatus according to a third embodiment of the present invention. In FIG. 8, between the lower beam of the car frame 3 and the lower portion of the car room 4, an actuator 37 that generates the vibration-damping force for reducing the lateral vibration generated in the car room 4 is provided. The acceleration sensor 8 and the vibration-damping control unit 9 are mounted in the car room 4. Further, actuators 17 are not provided in the roller guide devices 7. Other configurations are similar to those of the first embodiment.

Figure 9:
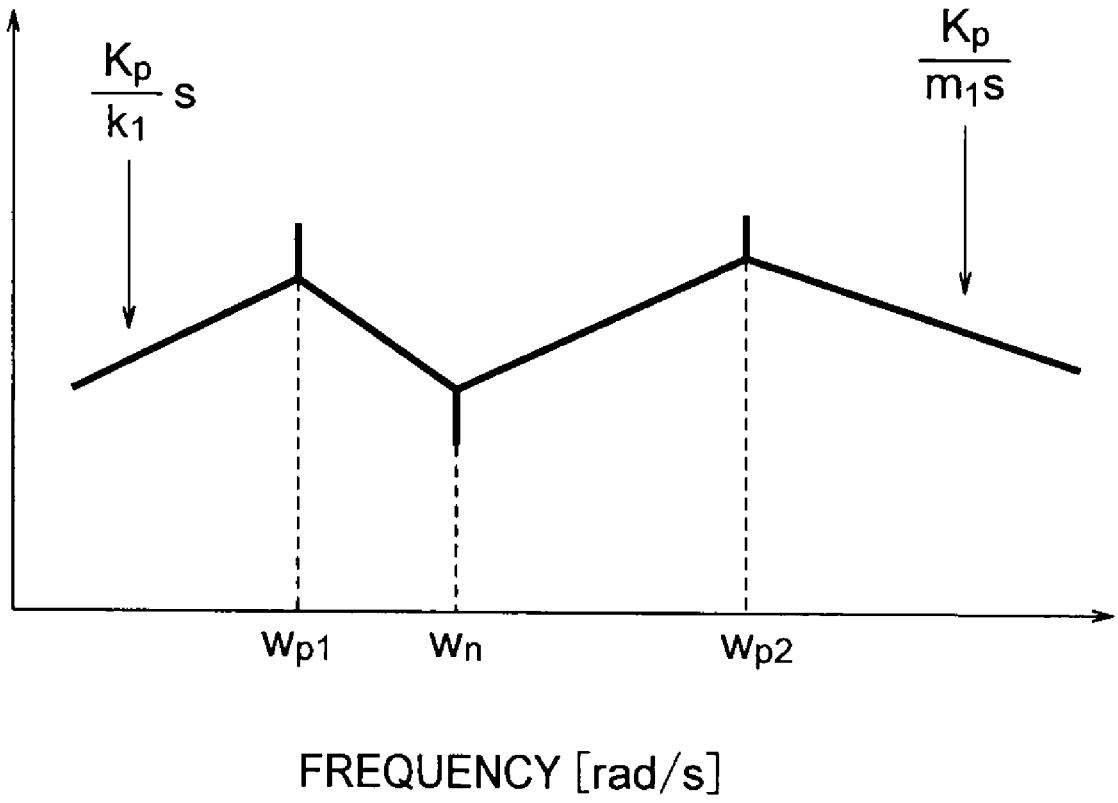
FIG. 9 A graph illustrating open-loop gain characteristics of a feedback loop composed of an actuator, an acceleration sensor, and a vibration-damping control unit of FIG. 8.

FIG. 9 is a graph illustrating open-loop gain characteristics of a feedback loop composed of the actuator 37, acceleration sensor 8 and vibration-damping control unit 9 of FIG. 8. Characteristics in the frequency range lower than the primary natural frequency wp1 are represented by Kp·s/k1, where the gain value of the multiplier 23 is Kp, and the Laplace operator is s.

Further, for reasons similar to the reasons shown in the first embodiment, as one of the designing methods of the gain value Kp in the multiplier 23, there is considered the method of setting the 0 dB level of the open-loop gain characteristics on the root of the peak at the primary natural frequency wp1. Hence, the design value of the gain value Kp becomes k1/wp1.

As described above, even in the case where the actuator 37 is provided between the car frame 3 and the car room 4, the gain value is determined on the basis of the natural frequency of the car 2 and the spring constant of the first equivalent spring 31 that exhibits the total rigidity of the vibration-isolating rubber pads 5 and the vibration-proof rubber pads 6, whereby the lateral vibration can be reduced more appropriately for various kinds of cars 2, the comfortable ride feeling can always be offered.

Note that, though an electromagnetic actuator is shown in the above-described examples, the actuator is not limited to this, and for example, an air actuator, a hydraulic actuator, a linear motor or the like may be used.

Further, though an acceleration sensor 8 is shown as the sensor in the above-described example, the sensor is not limited to this, and for example, the sensor may be a displacement sensor that detects displacement of the car room in the horizontal direction, the speed sensor that detects a speed of the car room in the horizontal direction, or the like.

Further, though the initial value of the natural frequency of the car is automatically calculated by the vibration-damping control unit in the above-described examples, the initial value may be inputted manually.

The invention claimed is:

1. An elevator apparatus, comprising:

a car;

an elastic member that isolates lateral vibration of the car;

a sensor that detects the lateral vibration of the car;

an actuator that is provided in parallel to the elastic member, and generates vibration-damping force against the lateral vibration of the car; and a vibration-damping control unit that, on the basis of information from the sensor, determines the vibration-damping force generated by the actuator, and controls the actuator, wherein the vibration-damping control unit estimates a natural frequency of the lateral vibration of the car, determines a gain value on the basis of the estimated natural frequency and a rigidity value of the elastic member, and drives the actuator in accordance with an instruction signal obtained by multiplication of the determined gain value.

2. The elevator apparatus according to claim 1, further comprising:

a guide rail that guides raising and lowering of the car; and a guide device mounted on the car, the guide device including a guide member engaged with the guide rail, and a spring as the elastic member that urges the guide member in a direction of abutting the guide rail, wherein the actuator is provided in parallel to the spring (16) of the guide device, and the vibration-damping control unit determines the gain value on the basis of a spring constant of the spring and the natural frequency of the car.

3. The elevator apparatus according to claim 1, wherein the vibration-damping control unit generates the lateral vibration for the car by the actuator, and estimates the natural frequency of the car on the basis of a vibration excitation signal at that time and a signal from the sensor.

4. The elevator apparatus according to claim 1, further comprising:

a load detection unit that detects a load on the car, wherein, during normal operation, the vibration-damping control unit corrects a reference value of the natural frequency of the car on the basis of information from the load detection unit, and thereby estimates the natural frequency.

5. The elevator apparatus according to claim 1, wherein the vibration-damping control unit detects a current flowing through the actuator, and estimates the natural frequency of the car from counter electromotive force determined on the basis of a voltage value directed to the actuator and a current value of the actuator.

6. The elevator apparatus according to claim 1, wherein the car includes a car frame and a car room supported by the car frame, the elastic member includes vibration-isolating member interposed between the car frame and the car room, the actuator is provided in parallel to the vibration-isolating member, and the vibration-damping control unit determines the gain value on the basis of a rigidity value of the vibration-isolating member and the natural frequency of the car.

* * * * *